US012768264B2

(12) United States Patent
Cabrera Ponce et al.

(10) Patent No.: US 12,768,264 B2
(45) Date of Patent: Oct. 20, 2026

(54) DOWNHOLE MONITORING

(71) Applicant: Schlumberger Technology Corporation, Sugar Land, TX (US)

(72) Inventors: Pablo Cabrera Ponce, Dhahran (SA); Chloe Coleou, Clamart (FR); Alain L. Guelat, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 309 days.

(21) Appl. No.: 18/693,228

(22) PCT Filed: Oct. 28, 2022

(86) PCT No.: PCT/US2022/048230
§ 371 (c)(1),
(2) Date: Mar. 19, 2024

(87) PCT Pub. No.: WO2023/076604
PCT Pub. Date: May 4, 2023

(65) Prior Publication Data

US 2024/0384647 A1 Nov. 21, 2024

Related U.S. Application Data

(60) Provisional application No. 63/272,894, filed on Oct. 28, 2021.

(51) Int. Cl.
*E21B 47/06* (2012.01)

(52) U.S. Cl.
CPC ..... *E21B 47/06* (2013.01)

(58) Field of Classification Search
CPC ..... E21B 47/06
See application file for complete search history.

(56) References Cited

U.S. PATENT DOCUMENTS

| | | | | |
|---|---|---|---|---|
| 4,628,995 | A | 12/1986 | Young | |
| 6,978,839 | B2 * | 12/2005 | Fenton | B01D 17/0217 166/368 |
| 7,363,980 | B2 * | 4/2008 | Pringle | E21B 34/08 166/332.8 |
| 9,803,430 | B2 | 10/2017 | Lafleur | |
| 11,332,981 | B2 * | 5/2022 | Lafleur | H01R 13/523 |
| 2013/0186626 | A1 * | 7/2013 | Aitken | E21B 43/08 166/373 |
| 2016/0251912 | A1 * | 9/2016 | Marcuccio | E21B 47/06 166/376 |
| 2017/0268326 | A1 | 9/2017 | Tao | |

FOREIGN PATENT DOCUMENTS

| | | | | |
|---|---|---|---|---|
| CN | 1484007 | A | 3/2004 | |
| EP | 0145537 | A2 | 6/1985 | |
| WO | WO-2017001378 | A1 * | 1/2017 | G01B 3/36 |

OTHER PUBLICATIONS

Search Report and Written Opinion of International Patent Application No. PCT/US2922/048230 on Feb. 24, 2023.

* cited by examiner

*Primary Examiner* — Jill E Culler
(74) *Attorney, Agent, or Firm* — Kyle R. Miiller

(57) ABSTRACT

A tubing to annulus converting olive allows for conversion of a tubing-reading monitoring system to an annulus monitoring system.

20 Claims, 3 Drawing Sheets

DOWNHOLE MONITORING

CROSS-REFERENCE TO RELATED APPLICATIONS

The present application is a National Stage Entry and claims benefit of PCT Patent Application No. PCT/US2022/048230, filed Oct. 28, 2022, which claims priority benefit of U.S. Provisional Application No. 63/272,894, filed Oct. 28, 2021, the entirety of which is incorporated by reference herein and should be considered part of this specification.

BACKGROUND

Field

The present disclosure generally relates to downhole monitoring.

Description of the Related Art

Completion systems for oil and gas wells can include various sensors, gauges, and mandrels. In various applications, it may be desirable to monitor tubing pressure or annulus pressure.

SUMMARY

In some configurations, a tubing to annulus converting olive includes one or more radially extending ports disposed about a circumference of the olive.

The olive can further include an axial port extending from an axial end of the olive into a body of the olive. The axial port does not extend through an entire axial length of the olive. The axial port intersects and is in fluid communication with the one or more radially extending ports. The olive can be metal. The olive can be sized and shaped to be disposed in a tubing pressure port of a gauge mandrel.

In some configurations, a monitoring system includes a gauge comprising a sensor and housed on a mandrel. The mandrel includes a pressure test port and a tubing pressure port configured to direct tubing pressure to the sensor. The system also includes a tubing to annulus converting olive disposed in the tubing pressure port and configured to block the tubing pressure port and allow annulus pressure to reach the sensor via a flow path through the pressure test port and the olive.

The mandrel can define a central longitudinal bore. The tubing pressure port extends radially through a wall of the mandrel from the central longitudinal bore. The tubing pressure port places the central longitudinal bore in fluid communication with the sensor of the gauge. The pressure test port places an annulus outside the mandrel in fluid communication with the sensor of the gauge.

The olive includes an axial port extending from an axial end of the olive partially through a body of the olive; and one or more radially extending ports disposed about a circumference of the olive, wherein the one or more radially extending ports are in fluid communication with the axial port. The olive is oriented such that the axial port is in fluid communication with the sensor of the gauge, and the olive blocks fluid communication between a central longitudinal bore of the mandrel and the sensor of the gauge.

In some configurations, a method of monitoring pressure in a wellbore includes determining whether to monitor tubing pressure or annulus pressure; and if monitoring annulus pressure, disposing a tubing to annulus converting olive in a tubing pressure port of a gauge mandrel. The method can further include monitoring annulus pressure via a flow path through a pressure test port of the gauge mandrel and through the tubing to annulus converting olive to a sensor of the gauge mandrel.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Completion systems for oil and gas wells can include various sensors, gauges, and mandrels. In some cases, it may not be known in advance if it will be desirable to read tubing or annulus pressure. It can therefore be necessary to have two different types of gauges and mandrels on hand, and too many variants becomes a challenge to FMT in or out and increases inventory on hand. The present application provides devices, systems, and methods including a tubing to annulus converting olive (or TACO). The tubing to annulus converting olive advantageously enables a completion including a tubing-reading gauge and a SGM (solid gauge mandrel) to read the tubing or the annulus pressure.

Figure 1:
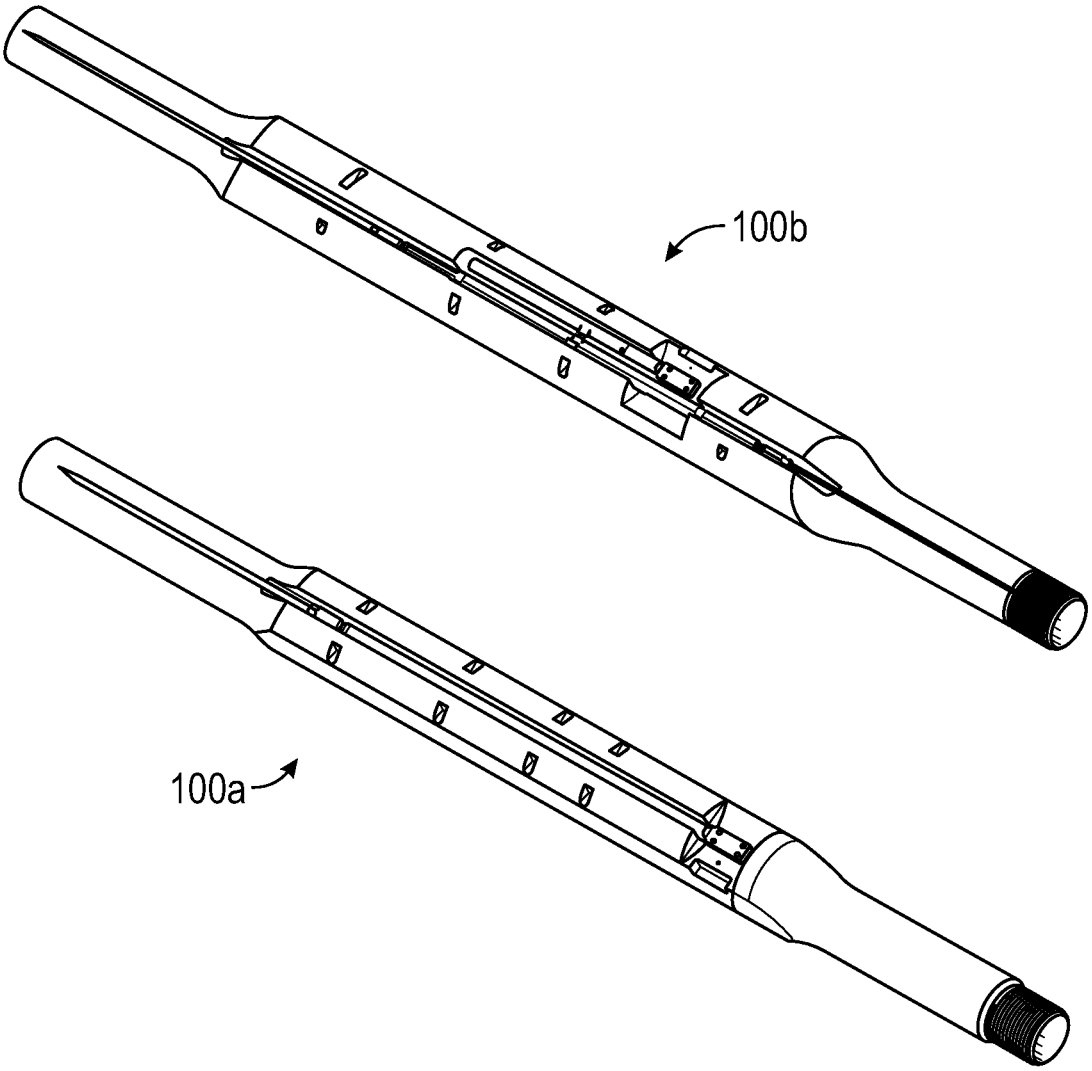
FIG. 1 shows an example single sensor gauge and an example single sensor gauge with feedthrough.

FIG. 1 shows an example single sensor gauge 100*a* and an example single sensor gauge with feedthrough 100*b*. The TACO of the present disclosure can be used with either of these single-sensor gauges 100*a*, 100*b*. The TACO advantageously simplifies FMT in or out, reduces the inventory required to be on hand, helps optimize manufacturing time, allows for part numbering rationalization, and/or standardizes on the shelf parts at the product center.

Figure 2:
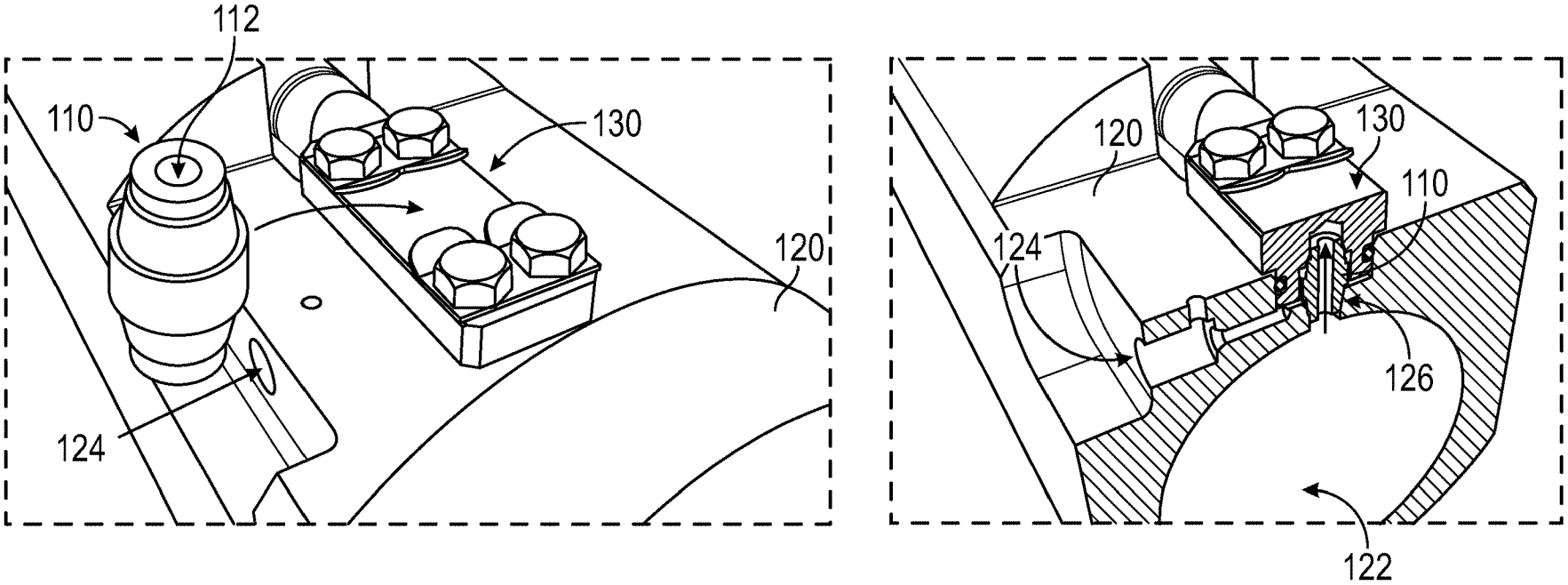
FIG. 2 illustrates an example standard tubing-reading monitoring system.

FIG. 2 illustrates an example standard tubing-reading monitoring system including a gauge 130 housed on a mandrel 120. A standard gauge olive 110 permits pressure reading from the tubing 122. The olive 110 is disposed in the tubing port 126, making a metal to metal seal with the mandrel 120, and allows the tubing pressure to go through a central axial bore 112 of the olive 110 to the sensor of the gauge 130.

Figure 3:
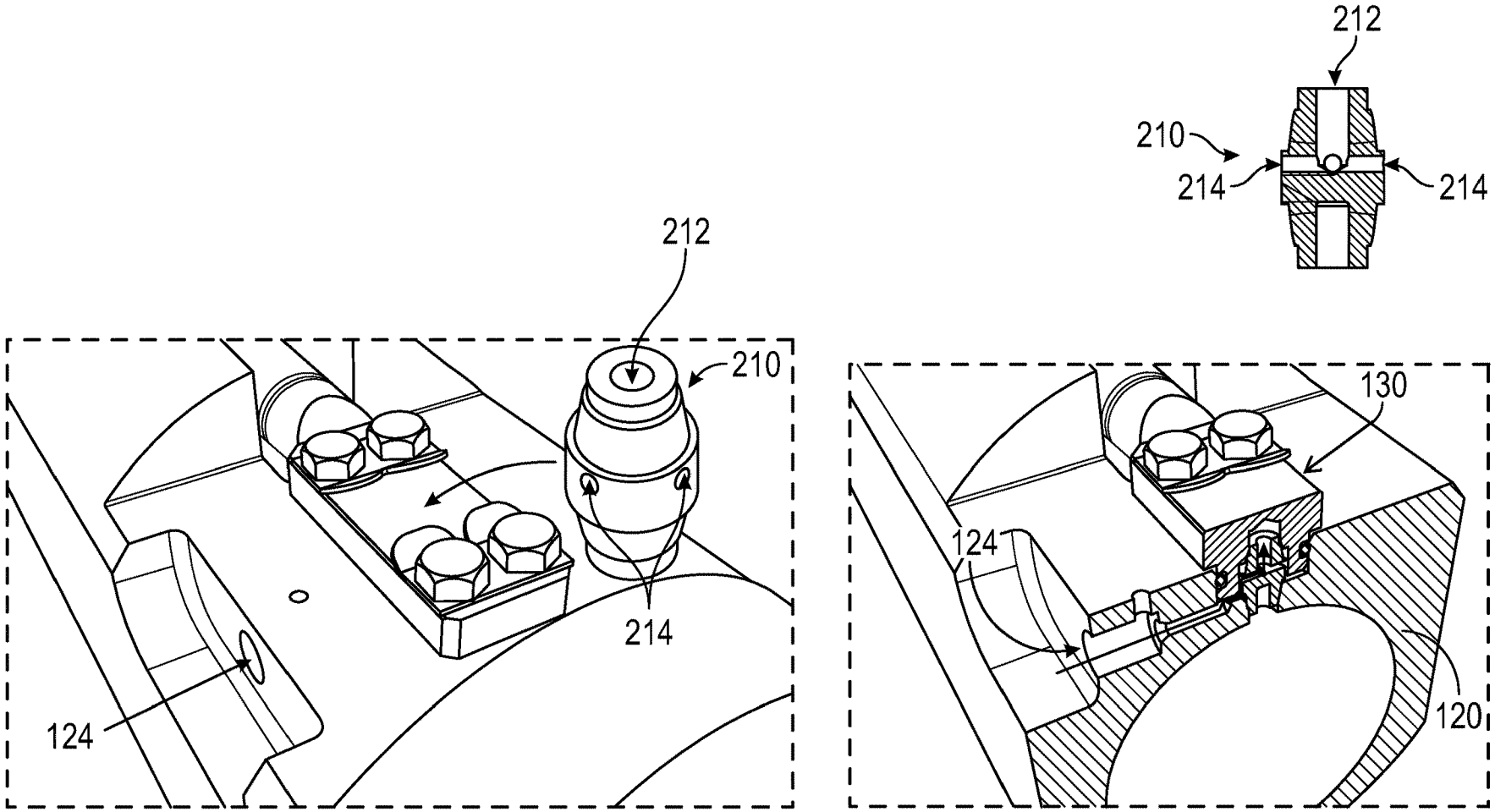
FIG. 3 illustrates an example tubing-reading gauge monitoring system including a tubing to annulus converting olive.

FIG. 3 illustrates an example tubing-reading gauge monitoring system including the TACO 210, such that the system is converted to an annulus reading system. The TACO 210 can be made of metal. The TACO 210 is sized and shaped to be disposed within the tubing port 126 of the mandrel 120. As shown in FIG. 3, the TACO 210 can have one or more radially extending holes 214 or ports disposed about its circumference. The radial ports 214 intersect and/or are in fluid communication with the central axial bore 212 of the TACO 210. The holes 214 allow the pressure test port 124 to be used to measure annulus pressure. The TACO 210 is used to plug the existing tubing port 126 of the SGM 120, and the pressure test port 124 is used for an annulus flow path. Annulus pressure goes through the pressure test port 124, through the radial hole(s) 214 of the TACO, and through the central axial bore 212 of the TACO 210 to the sensor of the gauge 130. As shown in FIG. 3, the central axial bore 212 of the TACO 210 can be blocked, or may not extend entirely through the TACO 210 such that the tubing pressure is prevented from traveling to the sensor of the gauge 130.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A system comprising:

a fluid fitting configured to mount in a mandrel in a tubing pressure port coupled to a central passage of the mandrel, wherein the fluid fitting comprises:

a body;

one or more radially extending ports disposed in the body about a circumference of the body, wherein the one or more radially extending ports are configured to receive a fluid from an annulus surrounding the mandrel; and an axial port disposed in the body, wherein the axial port is fluidly coupled to the one or more radially extending ports to define a fluid passage between the circumference and a first axial end portion of the body to deliver the fluid to a gauge, and the body blocks fluid communication between the fluid passage of the fluid fitting and the central passage of the mandrel.

2. The system of claim 1, wherein the axial port extends from the first axial end portion of the body of the fluid fitting over an axial distance to an axial position of the one or more radially extending ports.

3. The system of claim 2, wherein an outer surface of the body extends circumferentially around a central axis of the body, the axial port extends along the central axis, and the one or more radially extending ports are disposed in a first portion of the outer surface having a maximum diameter relative to the central axis.

4. The system of claim 3, wherein the one or more radially extending ports comprise a plurality of radially extending ports in the first portion of the outer surface, the first portion of the outer surface is disposed axially between second and third portions of the outer surface relative to the central axis, and the second and third portions have a smaller diameter than the maximum diameter of the first portion.

5. The system of claim 1, wherein the body-olive is metal.

6. The system of claim 1, wherein the one or more radially extending ports are configured to fluidly couple with a pressure test port in the mandrel in fluid communication with the annulus, and the fluid fitting is configured to extend into the gauge and into the tubing pressure port in a radial direction relative to an axis of the central passage of the mandrel.

7. The system of claim 1, further comprising the gauge having a sensor, wherein the fluid fitting extends at least partially into the gauge.

8. The system of claim 1, wherein the one or more radially extending ports comprise at least three radially extending ports intersecting the axial port.

9. The system of claim 8, wherein the at least three radially extending ports intersect the axial port at a common axial position.

10. The system of claim 1, wherein the axial port is blocked between the one or more radially extending ports and a second axial end portion of the body to block fluid communication with the central passage of the mandrel.

11. The system of claim 10, wherein the axial port is open at the first and second axial end portions, and the body has a blocking portion that blocks the axial port at an axial position between the first and second axial end portions.

12. A monitoring system comprising:

a gauge comprising a sensor and housed on a mandrel;

the mandrel comprising a pressure test port and a tubing pressure port configured to direct tubing pressure to the sensor, wherein the tubing pressure port is coupled to a central passage of the mandrel; and a fluid fitting disposed in the tubing pressure port, wherein the fluid fitting comprises:

a body;

one or more radially extending ports disposed in the body about a circumference of the body, wherein the one or more radially extending ports are configured to receive a fluid from an annulus surrounding the mandrel; and an axial port disposed in the body, wherein the axial port is fluidly coupled to the one or more radially extending ports to define a fluid passage between the circumference and a first axial end portion of the body to deliver the fluid to the gauge, and the body blocks fluid communication between the fluid passage of the fluid fitting and the central passage of the mandrel.

13. The system of claim 12, wherein the central passage of the mandrel is a central longitudinal bore extending along an axis.

14. The system of claim 13, wherein the tubing pressure port extends in a radial direction relative to the axis through a wall of the mandrel from the central longitudinal bore.

15. The system of claim 14, wherein the axial port of the fluid fitting extends in the radial direction relative to the axis.

16. The system of claim 15, wherein the pressure test port places the annulus outside the mandrel in fluid communication with the sensor of the gauge via the fluid passage in the fluid fitting.

17. The system of claim 12, wherein an outer surface of the body extends circumferentially around a central axis of the body, the axial port extends along the central axis, and the one or more radially extending ports are disposed in a first portion of the outer surface having a maximum diameter relative to the central axis.

18. The system of claim 17, wherein the first portion of the outer surface is disposed axially between second and third portions of the outer surface relative to the central axis, and the second and third portions have a smaller diameter than the maximum diameter of the first portion.

19. A method of monitoring pressure in a wellbore, the method comprising:

determining whether to monitor a central passage inside a mandrel or an annulus surrounding the mandrel;

disposing a fluid fitting in the mandrel in a tubing pressure port coupled to the central passage of the mandrel in response to a determination to monitor the annulus, wherein the fluid fitting comprises a body, one or more radially extending ports disposed in the body about a circumference of the body, and an axial port disposed in the body;

receiving, via the one or more radially extending ports, a fluid from the annulus into the fluid fitting, wherein the axial port is fluidly coupled to the one or more radially extending ports to define a fluid passage between the circumference and a first axial end portion of the body;

delivering, via the axial port, the fluid to a gauge coupled to the mandrel; and blocking, via the body, fluid communication between the fluid passage of the fluid fitting and the central passage of the mandrel.

20. The method of claim 19, further comprising monitoring an annulus pressure of the annulus via a flow path through a pressure test port of the mandrel and through the fluid fitting to a sensor of the gauge.

* * * * *